US005996503A

United States Patent [19]

Woodall et al.

[11] Patent Number: 5,996,503

[45] Date of Patent: Dec. 7, 1999

[54] REUSABLE GAS-POWERED HAND GRENADE

[75] Inventors: Robert Woodall, Lynn Haven; Felipe Garcia, Panama City, both of Fla.

[73] Assignee: The United States of America as represented by the Secretary of the Navy, Washington, D.C.

[21] Appl. No.: 09/066,706

[22] Filed: Apr. 27, 1998

[51] Int. Cl.[6] ..... F42B 8/12

[52] U.S. Cl. ..... 102/498; 102/482; 102/502; 102/513; 102/529; 473/577

[58] Field of Search ..... 102/357, 383, 102/393, 395, 440, 480, 482, 486, 489, 494–496, 498, 502, 513, 529; 473/577, 594

[56] References Cited

U.S. PATENT DOCUMENTS

| | | | |
|---|---|---|---|
| 1,737,833 | 12/1929 | D'Orsaneo | 102/480 |
| 4,319,426 | 3/1982 | Lee | 102/498 |
| 4,944,521 | 7/1990 | Greeno | 102/498 |
| 5,018,449 | 5/1991 | Eidson, II | 102/498 |
| 5,069,134 | 12/1991 | Pinkney | 102/498 |
| 5,078,117 | 1/1992 | Cover | 102/440 |
| 5,590,886 | 1/1997 | Lush | 102/498 |
| 5,877,448 | 3/1999 | Denton et al. | 102/498 |

FOREIGN PATENT DOCUMENTS

| | | | |
|---|---|---|---|
| 488236 | 9/1918 | France | 102/480 |
| 275694 | 6/1914 | Germany | 102/480 |

*Primary Examiner*—Harold J. Tudor

*Attorney, Agent, or Firm*—Harvey A. Gilbert; Donald G. Peck

[57] ABSTRACT

A reusable gas-powered hand grenade is provided. A hand-held housing defines one or more launch tubes. A projectile is loaded in each launch tube with an obturator being positioned therein between the projectile and the launch tube's muzzle end. A sealed reservoir is maintained in the housing for storing a gas under pressure. A rupturing device is mounted in the housing for breaking the reservoir's seal upon impact therewith. A triggering mechanism coupled to the rupturing device maintains separation between the rupturing device and the seal until the triggering mechanism is activated. Once activated, the triggering mechanism moves the rupturing device to impact the seal so that gas pressure propels the projectile and obturator from the launch tube.

15 Claims, 2 Drawing Sheets

REUSABLE GAS-POWERED HAND GRENADE

CROSS-REFERENCE TO RELATED PATENT APPLICATIONS

This patent application is with one related patent application entitled "REUSABLE GAS-POWERED WAR GAME LAND MINE", Ser. No. 08/986,981, filed Dec. 8, 1997, and now issued U.S Pat. No. 5,877,448, which is owned by the same assignee as this patent application.

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to hand grenades, and more particularly to a reusable, gas-powered hand grenade for ejecting projectiles such as paintballs.

BACKGROUND OF THE INVENTION

To adequately prepare military personnel, good military training must account for and simulate not only the use of hand grenades, but also their explosive fragmentation characteristics. To do this, it is necessary to have practice hand grenades for use in war games. An example of a war game marking grenade is disclosed in U.S. Pat. No. 4,944,521. Briefly, a number of paintballs are press-fit or glued into cavities formed in the grenade housing with each paintball extending partially outside the confines of the grenade housing. A compressed gas cylinder provided in the housing is pierced when the grenade is activated. The gas is directed within the grenade housing to a plurality of plugged channels, each of which leads to one cavity holding a paintball. When sufficient pressure builds in each plugged channel, the plug is propelled forward to impact the paintball such that the plug and paintball are ejected from the grenade housing.

The problems associated with the hand grenade disclosed in U.S. Pat. No. 4,944,521 are numerous. Since the paintballs extend beyond the confines of the grenade housing, premature rupturing of the paintballs can occur during handling of the grenade. Also, because each paintball extends partially outside the grenade housing and resides at the end of a plugged channel in which launch pressure is developed, each paintball is only exposed to launch pressure for a very brief time period. That is, once pressure in each plugged channel is sufficient to overcome frictional forces holding the plug and paintball in position, the paintball is immediately expelled from the grenade housing while the pressurized launch gas quickly expands. This limits the amount of acceleration each paintball can develop so that the range of each paintball is only a few feet. Since real grenades have ranges much greater than a few feet, realistic practice results cannot be achieved. Finally, since each paintball is impacted with a propelled plug, the paintball can fracture from the impact and, therefore, never be ejected in whole from the grenade housing.

SUMMARY OF THE INVENTION

Accordingly, it is an object of the present invention to provide a hand grenade that can simulate the explosive fragmentation characteristics of an exploding hand grenade.

Another object of the present invention is to provide a hand grenade that can be used in military and non-military war games.

Still another object of the present invention is to provide a hand grenade that is reusable.

Other objects and advantages of the present invention will become more obvious hereinafter in the specification and drawings.

In accordance with the present invention, a hand grenade has a housing defining at least one launch tube having a breech end and a muzzle end. At least one projectile is loaded in each launch tube between its breech and muzzle end. An obturator is positioned in the launch tube between the projectile and the muzzle end. A sealed reservoir is maintained in the housing for storing a gas under pressure. A rupturing device is mounted in the housing for breaking the reservoir's seal upon impact therewith. The rupturing device defines a channel through which the gas can flow from the reservoir to the breech end when the seal is broken. A triggering mechanism is coupled to the rupturing device for maintaining separation between the rupturing device and the seal until the triggering mechanism is activated. Once activated, the triggering mechanism moves the rupturing device to impact the seal after so that the gas can enter the breech end of the launch tube to increase pressure on the projectile sufficient to propel the projectile and obturator from the launch tube.

DETAILED DESCRIPTION OF THE INVENTION

Figure 1A:
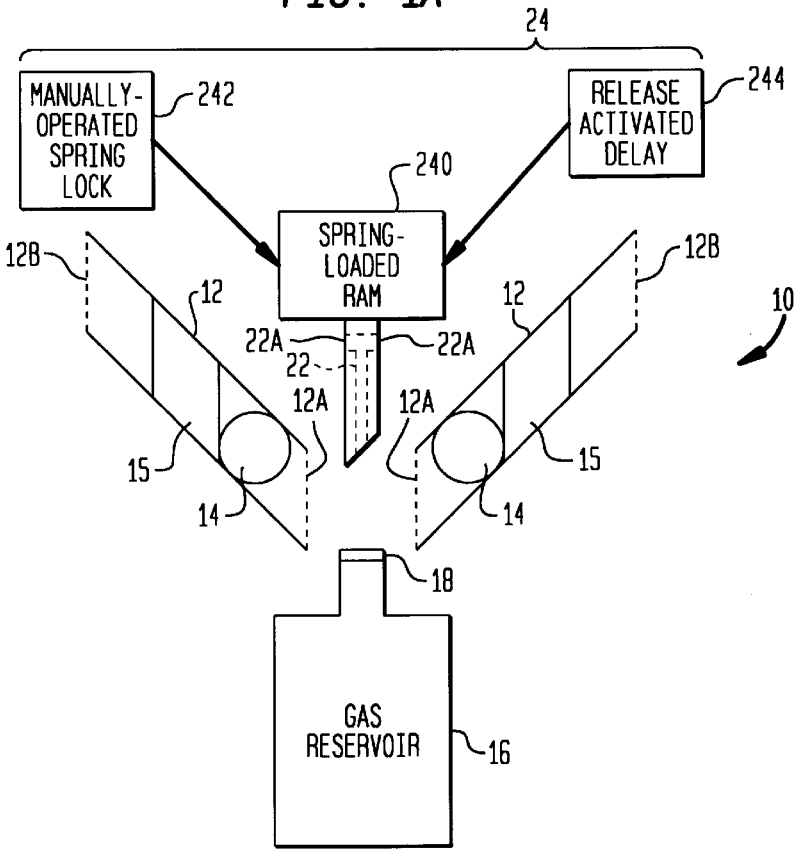
FIG. 1A is a schematic of the hand grenade of the present invention in its safe position.
Figure 1B:
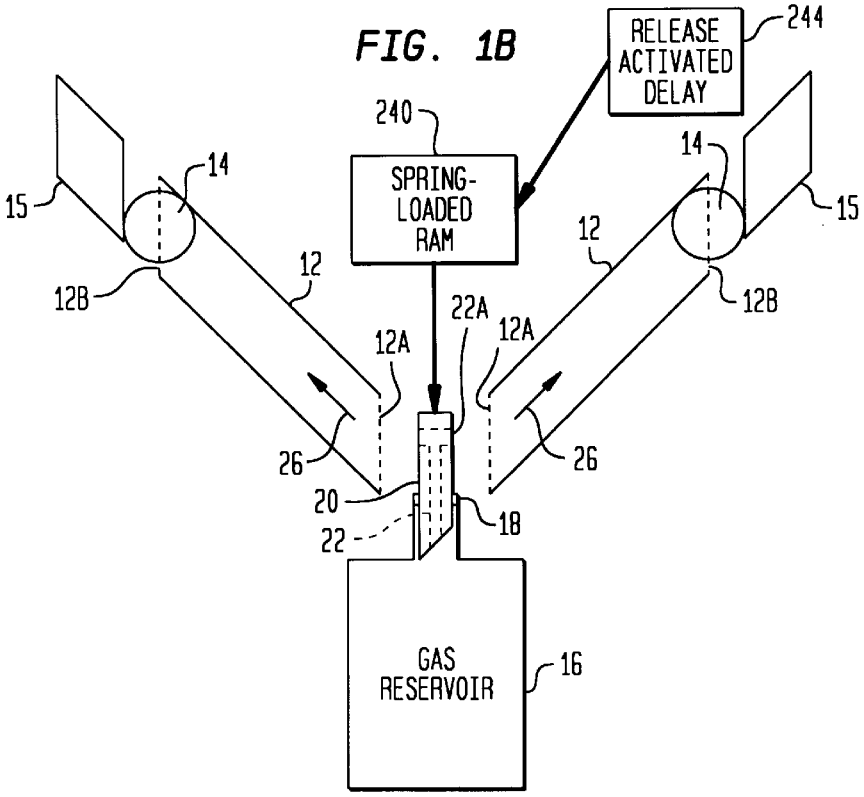
FIG. 1B is a schematic view of the hand grenade as it is simulating explosion characteristics.

Referring now to the drawings, and more particularly to FIGS. 1A and 1B, operational aspects and advantages of the present invention will first be described. A gas-powered hand grenade 10 of the present invention is shown in its "safe" position in FIG. 1A and as it is simulating explosive fragmentation characteristics in FIG. 1B. Hand grenade 10 can be used in both military and non-military scenarios to launch projectiles in a fashion that simulates the explosive fragmentation characteristics of a real grenade. By way of example, it will be assumed herein that the scenario is a war game scenario in which case the projectiles are non-lethal in nature. However, in general, the term projectile in the present invention extends to any injury-inflicting, lethal or non-lethal projectile.

Hand grenade 10 includes one or more launch barrels or tubes 12, each of which is aimed in a particular direction. Each launch tube 12 is loaded with a projectile 14. Note that more than one projectile 14 can also be loaded into each launch tube 12. In terms of a war game scenario, projectiles 14 can be frangible projectiles housing a marking agent (not shown). Such frangible projectiles are known in the art as paintballs. The marking agent can be a visible colorant or, in the case of security scenarios (e.g., banks, border crossings, etc.), the marking agent could be an ultraviolet-sensitive ink or any covert marking agent that could be detected at a later time and/or with special detectors.

A stop or obturator 15 is positioned between projectile 14 and muzzle end 12B of each launch tube 12. In the case where projectiles 14 are frangible in nature, e.g., paintballs, obturator 15 is a deformable and resilient plug press-fit into launch tube 12 to abut projectiles 14 therein. Obturator 15 thus serves as a shock absorber to prevent premature or inadvertent ejection and rupturing of projectiles 14. Obturator 15 also keeps projectiles 14 in place until sufficient launch pressure builds in launch tube 12 as will be explained further below. Suitable materials for obturator 15 include lightweight materials such as a polymeric (e.g., ethylene, urethane, polyethylene, etc.) foam, vinyl, sponge material, or other deformable and resilient materials.

To propel projectiles 14 from launch tubes 12, a non-lethal compressed gas (e.g., carbon dioxide, nitrogen, etc.) is provided within a gas tank or reservoir 16. Gas reservoir 16 is sealed at 18 by a rupturable seal. The release of the compressed gas into a breech end 12A of launch tube 12 is controlled by a rupturing pin 20. Once seal 18 is ruptured by pin 20, the outflow of gas from reservoir 16 will tend to push pin 20 out of reservoir 16 into breech ends 12A. However, pin 20 is also provided with an internal channel 22 defined therein to ensure and direct the outflow of gas from reservoir 16 once seal 18 is ruptured even if pin 20 gets stuck in seal 18.

To properly simulate a grenade's explosion characteristics, each projectile 14 must experience high acceleration. Since gas pressure will be used to accelerate projectiles 14 and since acceleration using such gas pressure is not instantaneous, each launch tube 12 with obturator 15 provides the means for increasing the acceleration of each projectile 14 prior to its leaving launch tube 12. That is, obturator 15 allows pressure to build behind projectile 14 until the frictional forces between obturator 15 (and projectile 14) and launch tube 12 are overcome. Further, launch tube 12 and obturator 15 keeps the launch pressure applied to projectile 14 all along launch tube 12. Since acceleration is a function of force and time, the longer the pressure force can be applied to projectile 14, i.e., along the length of launch tube 12, the longer acceleration works on projectile 14 and hence the greater the exit velocity of each projectile 14. The greater the exit velocity, the further each projectile 14 will fly.

Rupturing pin 20 is coupled to a trigger mechanism 24. In its "safe" position, trigger mechanism 24 maintains separation between pin 20 and seal 18 (FIG. 1A) . Once hand grenade 10 is activated and thrown, trigger mechanism 24 moves pin 20 to impact and rupture seal 18 after a time delay sufficient to allow hand grenade 10 to travel a safe distance from the launcher. More specifically, trigger mechanism 24 includes a spring-loaded ram 240 coupled to pin 20, a manually-operated spring lock 242 coupled to ram 240 and a release activated delay 244 also coupled to ram 240. Operationally, ram 240 is maintained in its spring-loaded position by lock 242 until such time that lock 242 is manually disabled. However, rather than allowing ram 240 to immediately act on pin 20 to move same towards seal 18, a second temporary lock in the form of delay 244 maintains ram 240 in its spring-loaded position for an additional period of time after lock 242 is disabled. Delay 244 is configured so that it can only start its "countdown" if and when lock 242 is disabled (represented in FIG. 1B by the omission of lock 242). Further, since hand grenade 10 is typically thrown, delay 244 is typically configured to begin its "countdown" once grenade 10 is released from the hand of the person throwing same.

The provision of internal channel 22 in pin 20 guarantees that the gas in gas reservoir 18 will be directed therethrough and exit pin 20 at vents 22A which can be aligned with or coupled to each breech end 12A. The build-up of gas (indicated by arrows 26) in breech ends 12A causes obturators 15 and projectiles 14 to launch from muzzle ends 12B.

Figure 2:
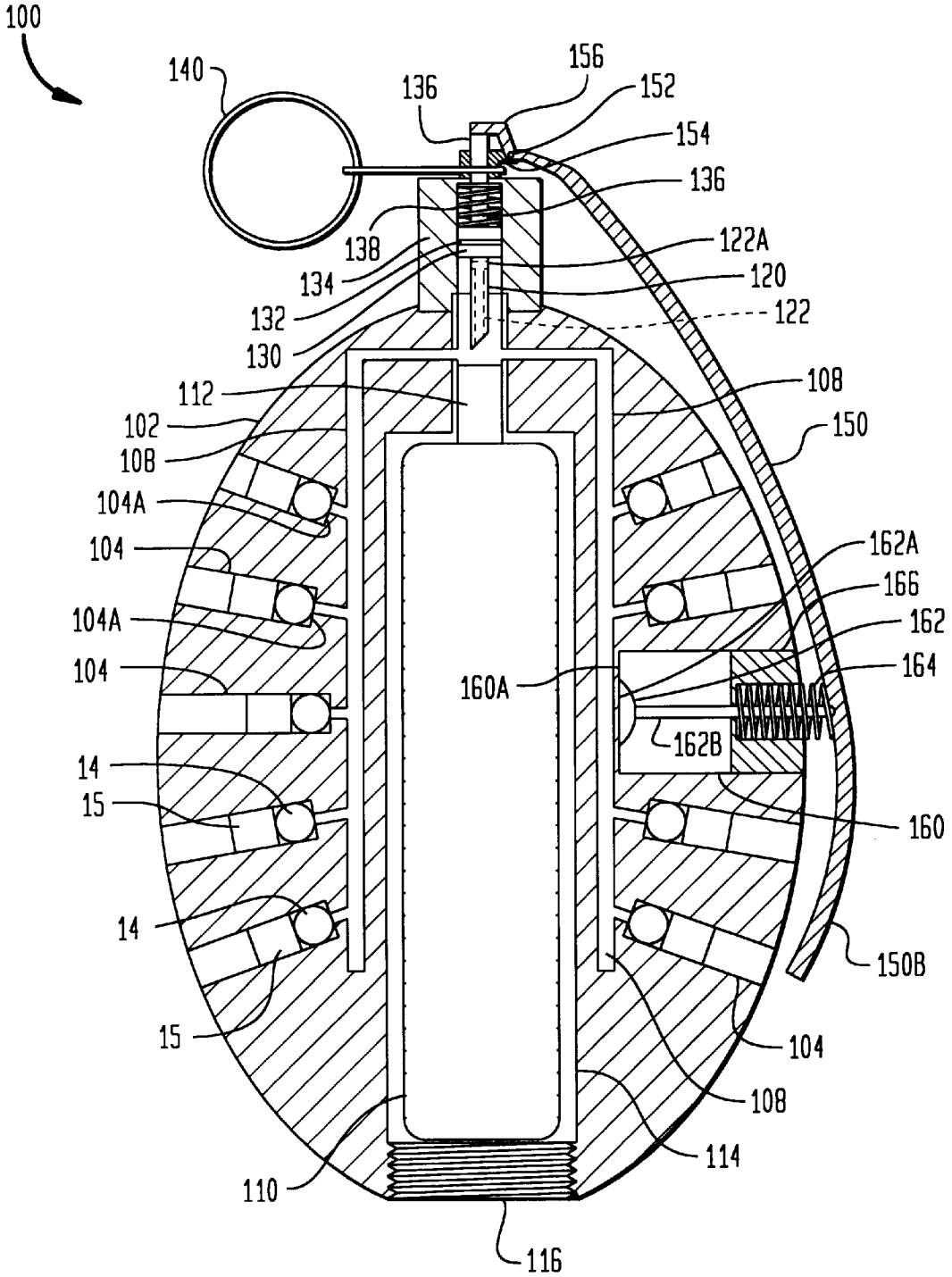
FIG. 2 depicts one embodiment of the gas-powered hand grenade according to the present invention shown in its safe position.

While the present invention can be realized by a variety of embodiments, one such embodiment is shown by way of illustrative example in FIG. 2. Hand grenade 100 includes a hand-held housing 102 having a plurality of launch tubes 104 arranged radially therearound. Launch tubes 104 can be arranged on a single tier or in multiple tiers. A breech end 104A of each launch tube 104 is open to a manifold 108. Each launch tube 104 has one (or more) projectile 14 held in place by obturator 15 as described above.

Disposed in housing 102 and central to manifold 108 is a compressed gas tank 110 containing, for example, carbon dioxide under pressure and sealed therein by seal 112. Gas tank 110 is housed within an internal chamber 114 formed in a central portion of housing 102. Gas tank 110 is inserted/removed from chamber 114 via a removable cap 116. Chamber 114 can be configured such that cap 116 will properly seat only if gas tank 110 is properly installed. A rupturing pin 120 having an internal channel 122 defined therein is provided in manifold 108. Channel 122 terminates in one or more vents 122A which empty into manifold 108. Accordingly, pin 120 and channel 122 are analogous to pin 20 and channel 22 described above.

An example is shown of a simple and reusable mechanical triggering mechanism that will move pin 120 to impact seal 112. As described above, trigger mechanism 24 consists of a spring-locked ram assembly coupled to pin 120, a locking mechanism for maintaining the ram assembly in its spring-loaded position and a second temporary locking assembly also coupled to the spring-loaded ram assembly. More specifically, the spring-loaded ram assembly consists of a ram piston 130 having an O-ring seal 132. Ram piston 130 with seal 132 are configured for a sealed, but sliding motion within a spring housing 134. Pin 120 is coupled to one side of ram piston 130 and a piston rod 136 is coupled to the other side of ram piston 130. Piston rod 136 extends up through spring housing 134 in which a triggering spring 138 is housed. Triggering spring 138 is captured between ram piston 130 and the top of spring housing 134. Where piston rod 136 protrudes from the top of spring housing 134, a pull pin 140 extends therethrough to lock the assembly in its spring-loaded position.

To arm hand grenade 100, pull pin 140 is manually removed thereby disabling the locking action provided thereby. However, pin 120 is still maintained in its spring-loaded position by a second temporary locking assembly and by the hand-grasp of the user. In the illustrated embodiment, the second temporary locking assembly is a plunger-type delay mechanism coupled to the exposed portion of piston rod 136. More specifically, a release lever 150 is pivotally coupled at 152 to a cam block 154 mounted to the top of spring housing 134. For illustration purposes, the position of lever 150 is shown in the same plane as launch tubes 104 rather than its actual position which would be misaligned with launch tubes 104. Lever 150 extends past pivot 152 over the top of piston rod 136 to define a firing cam 156 that is coupled to piston rod 136. Lever 150 is shaped to substantially conform to housing 102. Cooperating with lever 150 (typically near its free end 150B) is a time-delay spring-loaded plunger assembly installed in a plunger chamber 160 formed in housing 102. A suction-type plunger 162 is installed in chamber 160 such that plunger face 162A faces radially inward and plunger rod 162B extends radially outward with respect to housing 102. A plunger spring 164 cooperates between a spring seat 166 (fitted in plunger chamber 160) and lever 150 with spring 164 being biased to push radially outward on lever 150.

In operation, a user grasps hand grenade 100 to press lever 150 radially inward thereby pressing plunger face 162 up against the end face 160A of plunger chamber 160. Grenade 100 is then armed by removing pull pin 140. Next, the user throws grenade 100 towards a target. Upon release from the user's hand, lever 150 is only temporarily restrained by the resistive force provided between plunger face 162A and end face 160A. Plunger spring 164 is free to urge lever 150 outward. (The amount of time delay can be adjusted by the selection of type and size of plunger 162 and/or the size of plunger spring 164.) At the same time, triggering spring 138 is acting to push pin 120 towards seal 112 and acting to pivot lever 150 about pivot 152. Plunger 162 temporarily slows this action until the resistive force between plunger face 162A and end face 160A is overcome. Once this occurs, lever 150 is free to pivot about pivot 152 and pin 120 is driven to break seal 112 by ram piston 130.

The advantages of the present invention are numerous. The hand grenade can eject standard paintballs (or other projectiles) through launch tubes at velocities sufficient to propel the projectiles several meters thereby simulating the effect of a real grenade. Ejection power is supplied from readily-available gas cartridges. The present invention eliminates premature rupture of paintballs by holding them in place with the use of foam plugs. Further, the use of a hollow and vented rupture pin provides a secondary gas release path so that the grenade will function even if the rupture pin gets stuck in the gas tank seal. The hand grenade is simple to construct and can be easily used over and over again. The present invention will find great utility in military training, for recreational war games and in security scenarios. Paintballs can be filled with a marking agent to mark targets for instant and/or later detection.

Although the invention has been described relative to a specific embodiment thereof, there are numerous variations and modifications that will be readily apparent to those skilled in the art in light of the above teachings. For example, a different trigger mechanism could be used. Still further, projectiles 14 could be injury-inflicting, lethal or non-lethal in nature depending on the application. It is therefore to be understood that, within the scope of the appended claims, the invention may be practiced other than as specifically described.

What is claimed as new and desired to be secured by Letters Patent of the United States is:

1. A reusable practice hand grenade, comprising:

a housing defining at least one launch tube having a breech end and a muzzle end;

at least one projectile loaded in said at least one launch tube between said breech end and said muzzle end;

an obturator positioned in said at least one launch tube and abutting said at least one projectile, wherein a portion of said at least one launch tube extends beyond said obturator towards said muzzle end;

a reservoir maintained in said housing for storing a gas under pressure, said reservoir having a seal;

a rupturing device mounted in said housing for breaking said seal upon impact therewith, said rupturing device defining a channel through which said gas can flow from said reservoir to said breech end when said seal is broken; and a triggering mechanism coupled to said rupturing device for maintaining separation between said rupturing device and said seal until said triggering mechanism is activated, and for moving said rupturing device to impact said seal after said triggering mechanism is activated wherein said gas enters said breech end of said at least one launch tube to increase pressure on said at least one projectile sufficient to propel said at least one projectile and said obturator along said portion of said at least one launch tube and from said at least one launch tube.

2. A reusable practice hand grenade as in claim 1 wherein said at least one launch tube comprises a plurality of launch tubes, said hand grenade further comprising a manifold coupling said channel to each breech end of said plurality of launch tubes.

3. A reusable practice hand grenade as in claim 1 wherein said at least one projectile is a frangible projectile housing a marking agent.

4. A reusable practice hand grenade as in claim 1 wherein said gas is non-lethal.

5. A reusable practice hand grenade as in claim 1 wherein said triggering mechanism comprises:

a spring-loaded ram coupled to said rupturing device, said spring-loaded ram having a spring-loaded position at which said rupturing device assumes a bias towards said seal and at which said separation is maintained between said rupturing device and said seal;

a first locking mechanism coupled to said spring-loaded ram for continuously maintaining said spring-loaded position until said first locking mechanism is manually disabled; and a second locking mechanism coupled to said spring-loaded ram for temporarily maintaining said bias and said separation for a period of time after said first locking mechanism is manually disabled and said hand grenade is thrown, wherein said bias is allowed to move said rupturing device towards said seal for impact therewith after said period of time.

6. A reusable practice hand grenade as in claim 1 wherein said obturator is made of a deformable and resilient material.

7. A reusable practice hand grenade, comprising:

a hand-held housing defining a plurality of launch tubes, each of said plurality of launch tubes having a breech end and a muzzle end;

at least one projectile loaded in each of said plurality of launch tubes between said breech end and said muzzle end;

an obturator positioned in each of said plurality of launch tubes and abutting said at least one projectile, wherein a portion of each of said launch tubes extends beyond said obturator towards said muzzle end;

a reservoir for storing a gas under pressure, said reservoir having a seal;

a manifold coupling said reservoir at said seal to each said breech end of said plurality of launch tubes;

a rupturing device mounted in said housing for breaking said seal upon impact therewith, said rupturing device defining a channel through which said gas can flow from said reservoir into said manifold when said seal is broken; and a triggering mechanism coupled to said rupturing device for maintaining separation between said rupturing device and said seal until said triggering mechanism is activated, and for moving said rupturing device to impact said seal when said triggering mechanism is activated wherein said gas enters each said breech end of said plurality of launch tubes via said manifold to increase pressure on said at least one projectile sufficient to propel said at least one projectile and said obturator along said portion of said launch tube and from each of said plurality of launch tubes.

8. A reusable practice hand grenade as in claim 7 wherein said at least one projectile is a frangible projectile housing a marking agent.

9. A reusable practice hand grenade as in claim 7 wherein said gas is non-lethal.

10. A reusable practice hand grenade as in claim 7 wherein said triggering mechanism comprises:

a spring-loaded ram coupled to said rupturing device, said spring-loaded ram having a spring-loaded position at which said rupturing device assumes a bias towards said seal and at which said separation is maintained between said rupturing device and said seal;

a first locking mechanism coupled to said spring-loaded ram for continuously maintaining said spring-loaded position until said first locking mechanism is manually disabled; and a second locking mechanism coupled to said spring-loaded ram for temporarily maintaining said bias and said separation for a period of time after said first locking mechanism is manually disabled and said hand grenade is thrown, wherein said bias is allowed to move said rupturing device towards said seal for impact therewith after said period of time.

11. A reusable practice hand grenade as in claim 7 wherein said obturator is made of a deformable and resilient material.

12. A reusable practice hand grenade, comprising:

a hand-held housing defining a central chamber therein;

a plurality of launch tubes disposed in said housing and arranged radially around said central chamber, each of said plurality of launch tubes having a breech end and a muzzle end;

at least one projectile loaded in each of said plurality of launch tubes between said breech end and said muzzle end;

an obturator positioned in each of said plurality of launch tubes and abutting said at least one projectile, wherein a portion of each of said launch tubes extends beyond said obturator towards said muzzle end;

a reservoir positioned in said central chamber for storing a gas under pressure, said reservoir having a seal;

a manifold coupling said reservoir at said seal to each said breech end of said plurality of launch tubes;

a rupturing device mounted in said housing for breaking said seal upon impact therewith, said rupturing device defining a channel through which said gas can flow from said reservoir into said manifold when said seal is broken;

a spring-loaded ram coupled to said rupturing device, said spring-loaded ram having a spring-loaded position at which said rupturing device assumes a bias towards said seal and at which said separation is maintained between said rupturing device and said seal;

a first locking mechanism coupled to said spring-loaded ram for continuously maintaining said spring-loaded position until said first locking mechanism is manually disabled; and a second locking mechanism coupled to said spring-loaded ram for temporarily maintaining said bias and said separation for a period of time after said first locking mechanism is manually disabled and said hand grenade is thrown, wherein said bias is allowed to move said rupturing device towards said seal for impact therewith after said period of time.

13. A reusable practice hand grenade as in claim 12 wherein said at least one projectile is a frangible projectile housing a non-lethal marking agent.

14. A reusable practice hand grenade as in claim 12 wherein said compressed gas is non-lethal.

15. A reusable practice hand grenade as in claim 12 wherein said obturator is made of a deformable and resilient material.

* * * * *